US012479686B2

(12) United States Patent
Sternberg et al.

(10) Patent No.: US 12,479,686 B2
(45) Date of Patent: Nov. 25, 2025

(54) AUTOMATIC TAPE DISPENSING SYSTEM

(71) Applicants: Todd Sternberg, Addison, TX (US); Nobuhiro Tsuchiya, Tokyo (JP)

(72) Inventors: Todd Sternberg, Addison, TX (US); Nobuhiro Tsuchiya, Tokyo (JP)

( * ) Notice: Subject to any disclaimer, the term of this patent is extended or adjusted under 35 U.S.C. 154(b) by 0 days.

(21) Appl. No.: 18/400,129

(22) Filed: Dec. 29, 2023

(65) Prior Publication Data

US 2024/0132319 A1 Apr. 25, 2024

Related U.S. Application Data

(63) Continuation of application No. 17/129,411, filed on Dec. 21, 2020, now Pat. No. 11,866,284.

(51) Int. Cl.
*B65H 35/00* (2006.01)

(52) U.S. Cl.
CPC ..... *B65H 35/0026* (2013.01); *B65H 2555/25* (2013.01); *B65H 2557/20* (2013.01)

(58) Field of Classification Search
CPC ..... B65H 35/0026; B65H 35/0006; B65H 35/0033; B65H 2553/43
See application file for complete search history.

(56) References Cited

U.S. PATENT DOCUMENTS

| | | | | |
|---|---|---|---|---|
| 2,591,559 | A | 4/1952 | Krueger | |
| 2,777,594 | A | 1/1957 | Krueger | |
| 3,770,222 | A | 11/1973 | Jespersen | |
| 3,802,309 | A * | 4/1974 | Bosland | B65H 35/002 83/205 |
| 4,383,657 | A | 5/1983 | Suh | |
| 5,628,474 | A | 5/1997 | Krueger et al. | |
| 5,934,535 | A | 8/1999 | Kannakeril et al. | |
| 6,279,806 | B1 | 8/2001 | Simhaee | |
| 6,488,222 | B1 | 12/2002 | West et al. | |
| 6,561,403 | B1 | 5/2003 | Kannankeril et al. | |
| 6,672,532 | B1 | 1/2004 | Huang | |
| 7,069,972 | B1 | 7/2006 | Edelstein | |
| 7,398,944 | B2 | 7/2008 | Lewis et al. | |
| 8,905,283 | B2 | 12/2014 | Tan | |
| 9,604,811 | B2 * | 3/2017 | Case | B65H 16/005 |
| 2002/0176059 | A1 * | 11/2002 | Lucey | B65H 43/08 355/75 |
| 2007/0125902 | A1 | 6/2007 | Alalu et al. | |
| 2007/0193917 | A1 | 8/2007 | Munoz et al. | |
| 2019/0092597 | A1 | 3/2019 | Carrion et al. | |

FOREIGN PATENT DOCUMENTS

| | | | | |
|---|---|---|---|---|
| CN | 106395484 A * | 2/2017 | | B65H 20/02 |
| DE | 2020016103375 U1 | 10/2016 | | |
| DE | 10 2021 200 342 A1 | 7/2021 | | |
| EP | 0607764 A1 * | 7/1994 | | |

(Continued)

*Primary Examiner* — Jennifer S Matthews
(74) *Attorney, Agent, or Firm* — Foley & Lardner LLP

(57) ABSTRACT

An automatic tape dispenser including a controller, a reel for supporting tape roll thereon, and a feed system configured to receive the tape and peel the tape from the tape roll. The system further includes a sensor communicatively coupled to the controller, wherein the sensor is operable to detect a characteristic of the tape such that in response to detecting the characteristic, an operation of the feed system is adjusted.

22 Claims, 7 Drawing Sheets

(56) References Cited

FOREIGN PATENT DOCUMENTS

| | | | | | |
|---|---|---|---|---|---|
| EP | 0 719 720 | A1 | | 7/1996 | |
| FR | 2969991 | A1 | | 7/2012 | |
| GB | 2 081 219 | A | | 2/1982 | |
| KR | 920004064 | B1 | | 5/1992 | |
| KR | 20100002684 | U | * | 3/2010 | |
| WO | WO-9719013 | A1 | * | 5/1997 | ..... A47F 13/085 |

* cited by examiner

AUTOMATIC TAPE DISPENSING SYSTEM

CROSS-REFERENCE TO RELATED APPLICATION

This disclosure is a continuation of and claims priority to U.S. patent application Ser. No. 17/129,411, filed on Dec. 21, 2020, now U.S. Pat. No. 11,866,284, the entire disclosure of which is hereby incorporated by reference in its entirety.

TECHNICAL FIELD

This disclosure relates to tape dispensers, and more particularly, to automatic tape dispensers, and even more particularly, to automatic tape dispensers configured to automatically dispense lengths of tape for a user.

BACKGROUND OF THE DISCLOSURE

Common tape dispensing devices require users to manually grasp a portion of the tape, pull it from its roll, and tear it across a serrated edge of the dispenser. In certain devices, however, dispensing of the tape from the device is automated, which upon actuation, causes a predetermined length of tape to feed out from the device. In many of these devices, it is oftentimes still necessary to manually grasp the dispensed tape and pull it across a cutting edge. Furthermore, such devices are susceptible to malfunction due to ineffective tensioning of the tape and are costly to maintain. There is a need to provide an automatic tape dispenser to overcome these and other challenges.

SUMMARY

According to a first aspect, there is provided an automatic tape dispenser including a controller, a reel for supporting tape thereon and a feed system configured to peel and receive tape from a tape roll. The system further includes a sensor communicatively coupled to the controller, wherein the sensor is operable to detect a characteristic of the tape such that in response to detecting the characteristic, an operation of the feed system is adjusted.

According to a second aspect, there is provided an automatic tape dispensing system that includes a feed system having a plurality of rollers, the feed system configured for peeling a tape from a tape roll and dispensing the tape from the dispensing system. The system further includes a reel for supporting the tape thereon, the reel having an axis, a deck for supporting the tape roll thereon and a track for supporting the reel. In use, the reel moves along the track such that in response to tape being dispensed from the dispensing system, the axis moves in a direction closer to the deck. The system is configured such that the deck exerts a normal force in a direction perpendicular to a point where the tape roll contacts the deck in order to maintain a desired tension on the tape roll.

DESCRIPTION OF THE FIGURES

The accompanying drawings facilitate an understanding of the various embodiments.

Like elements are labeled using like numerals.

DETAILED DESCRIPTION

Figure 1:
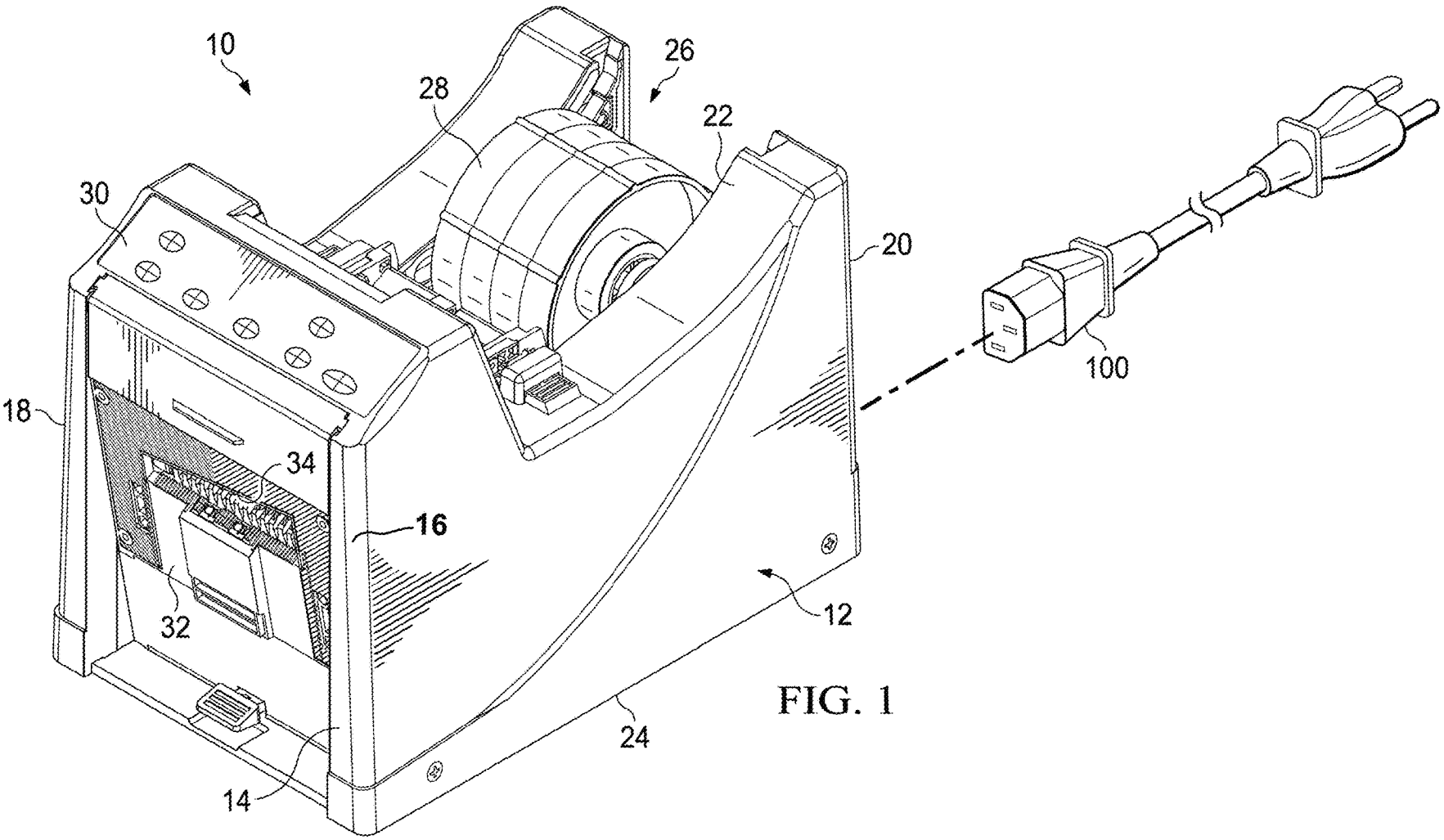
FIG. 1 is a perspective view of an automatic tape dispenser system.

Referring to the embodiment illustrated in FIG. 1 a self-tensioning tape dispensing system 10 is illustrated for dispensing measured lengths of tape therefrom. The tape dispensing system 10 includes a removable cover 12, which as explained in greater below, provides access to the internal operational components. The cover 12 is formed having a front wall 14, a pair of sidewalls 16 and 18, a rear wall 20, and top and bottom walls 22 and 24, respectively. In the embodiment illustrated in FIG. 1, the rear and top walls 20 and 22 have slots/openings forming a recess 26 for receiving a reel assembly 28, the reel assembly 28 rotatably supporting one or more rolls of tape 74 (FIG. 5) thereon.

In the embodiment illustrated in FIG. 1, the front wall includes a display panel 30 and a removable cutter cover 32 for providing access to and enclosing a cutting assembly (not illustrated). The cover 32 further includes an opening 34 for allowing measured lengths of tape to be dispensed from the system 10. In operation and as explained in further detail below, the system 10 is designed such that an adequate level of tension is applied to the tape to enable the tape to be automatically fed through the system 10 and peeled away from the roll while at the same time eliminating and/or substantially reducing the likelihood of misfeeds and malfunctioning of the system 10. During use, a desired length of tape is ejected through the exit opening 34. The process automatically repeats after the tape is removed from the exit opening 34.

Figure 2:
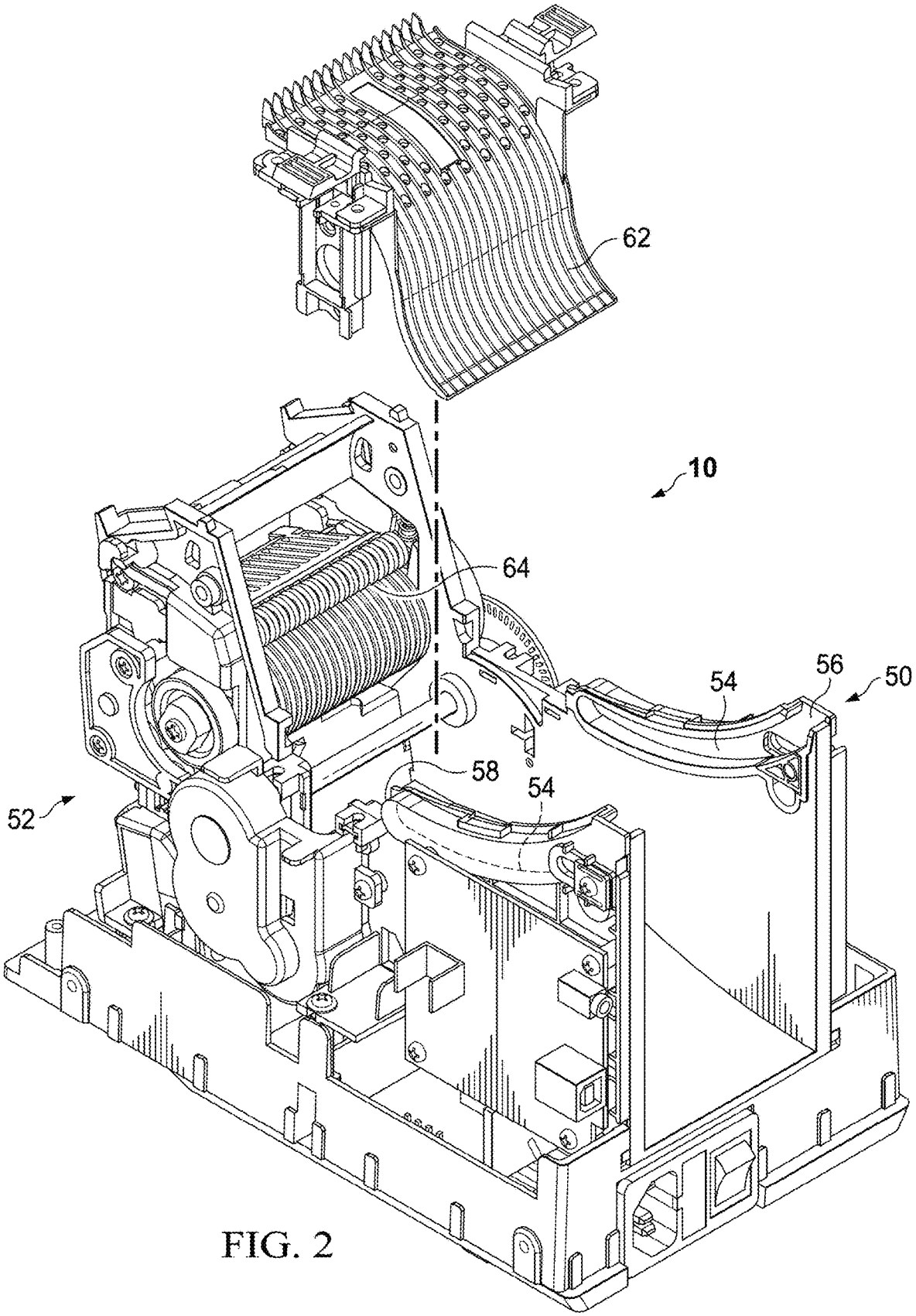
FIG. 2 is a rear perspective view of the tape dispenser system with the outer cover removed.
Figure 3:
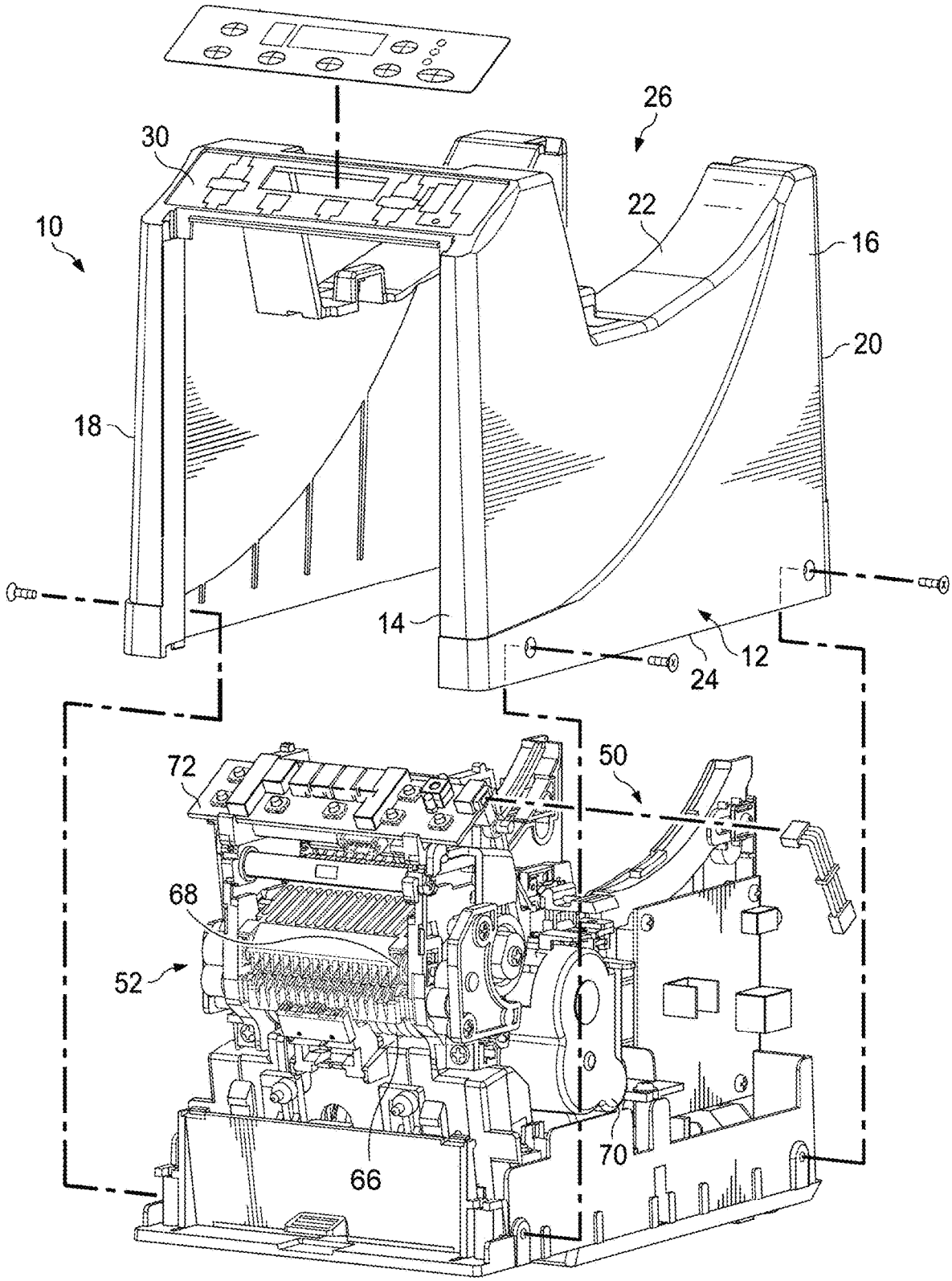
FIG. 3 is a front perspective view of the tape dispenser system of FIGS. 1 and 2 with the outer cover removed.

Referring to FIGS. 2 and 3, the dispensing system 10 is illustrated with the cover 12 removed and otherwise detached from the system 10. In FIGS. 2 and 3, a reel guide assembly 50 and the feed system 52 are illustrated, which during operation, enables measured lengths of tape to be dispensed from the dispensing system 10. In the embodiment illustrated in FIGS. 2 and 3, the reel guide assembly 50 is formed having a track 54 to slideably support the reel 28 therein. In particular and with further reference to FIGS. 4A and 4B, the reel 28 is formed having a shaft 60 having ends of a predetermined diameter sized to fit within the track 54. As illustrated in the embodiment shown in FIGS. 2 and 3, the track 54 arcuately extends from an uppermost first end 56 downwardly toward a bottommost second end 58 such that as tape is peeled off of the roll 74 and the diameter of the roll 74 decreases as a result, the arcuately formed track enables the reel 28, and thus, the roll of tape 74, to gradually move downward via gravity toward the feed system 52. The shape of the track 54 positions the reel 28, and thus the roll of tape 74, to facilitate and otherwise create sufficient tension on the tape when tape is being peeled from the tape roll 74 in response to feeding the tape into the feed system 52. While the embodiment illustrated in FIGS. 2 and 3 shows a downwardly and arcuately formed track 54, it should be understood that other configurations of the track 54 are possible. For example, the track 54 may be formed along a downwardly sloped linear path from the first end 56 to the second end 58. Furthermore, the arcuately shaped track 54 could be formed having any arcuate path (e.g, a greater or smaller slope) or could be any combination thereof. In operation and as explained in greater detail below, regardless of the shape of the track 54, the track 54 is formed so that the reel 28, and thus, the tape roll 74, continuously slide downward toward the feed system 52 as tape is being dispensed in order to provide tension on the tape during operation.

With continued reference to FIGS. 2 and 3, the feed system 52 includes the tape support deck 62, a push roller 64, a plurality of feed rollers 66 and 68, and a motor/gearbox assembly 70, the assembly operable to drive the feed rollers 66 and 68 to advance the tape through the system 52 for eventual output through the exit opening 34 (FIG. 1).

Figure 4A:
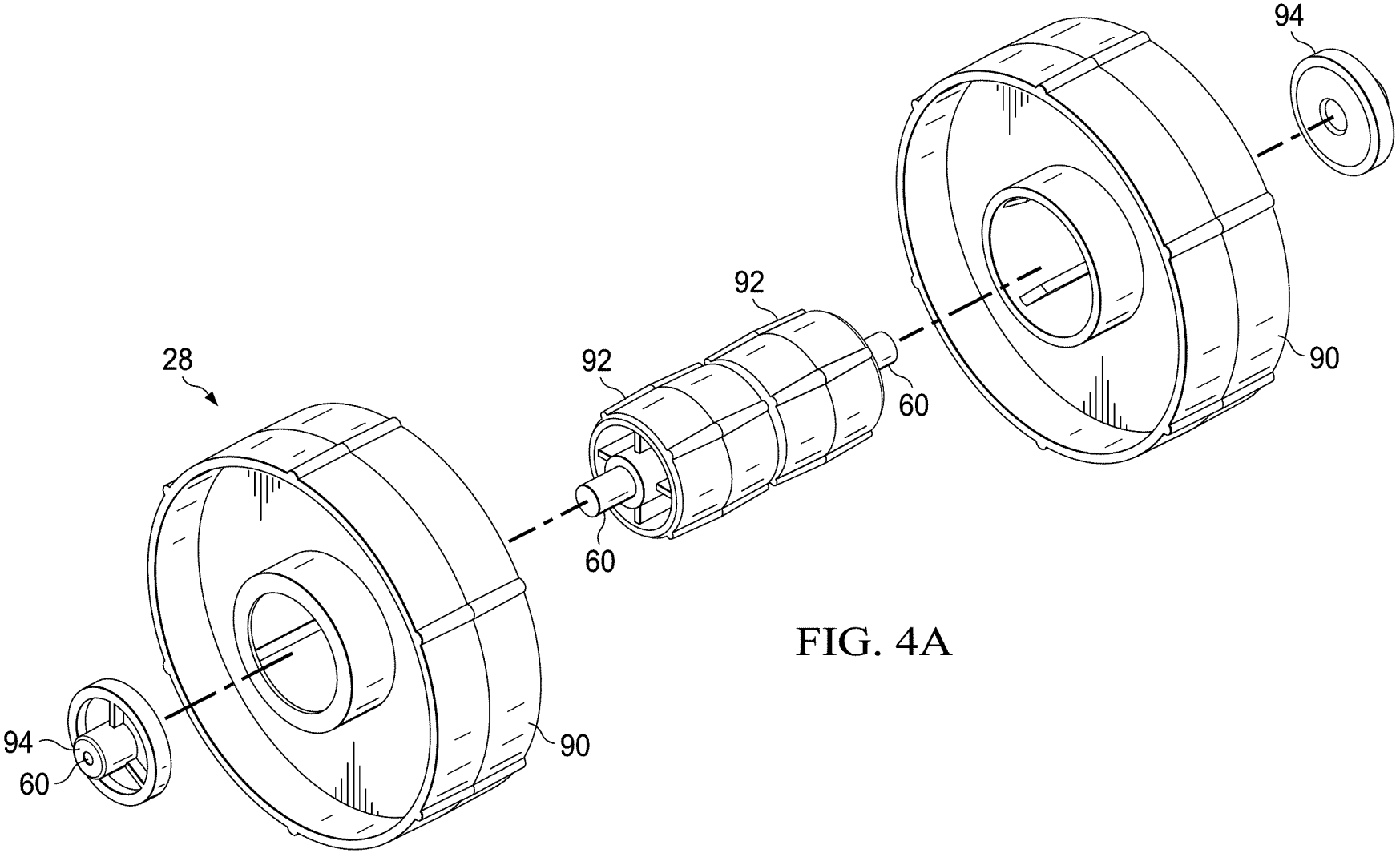
FIG. 4A is an exploded perspective view of the reel assembly.
Figure 4B:
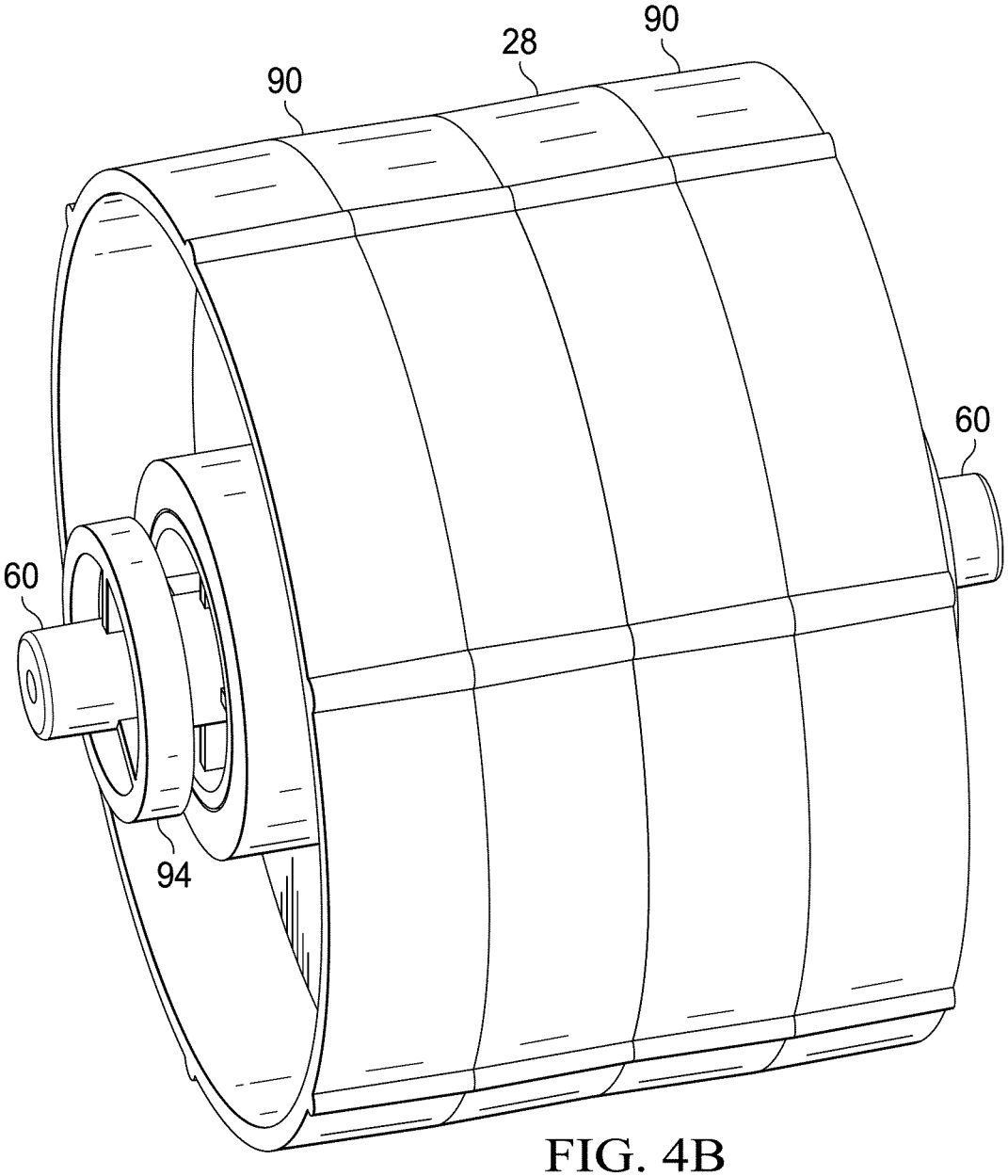
FIG. 4B is a perspective view of the reel assembly of FIG. 4A.

Referring to FIGS. 4A and 4B, the reel assembly 28 is illustrated in greater detail. In the embodiment illustrated in FIG. 4A, for example, the reel assembly 28 includes an outer reel 90 removeably disposed over and around an inner reel 92, the shaft 60 and optionally, a pair of end caps 94. Depending on the inner diameter of the tape roll 74, an appropriately sized reel 90 or 92 may be used. During use, the outer reel 90 is disposed over the inner reel 92 when a larger inner diameter of tape roll 74 is being used. Alternatively, the reel assembly 28 can be used within an outer reel 92 in instances where the inner diameter of the tape roll 74 is smaller. It should be understood, however, that reels of differing diameters can be used. Regardless of the configuration of the reel assembly 28, the reel assembly includes a shaft 60 that has a diameter to enable sliding engagement within the track 54, as described herein. In other embodiments, the shaft 60 can rest on the top wall of 22 of the cover 12 in lieu of sliding in the track 54. In still other embodiments, the shaft 60 can be mounted in a rotatably fixed position so that it rotates and in response to operation of the system 10 and does not, in addition to rotation, move closer to the feed system 52. In addition, while FIGS. 4A and 4B illustrate two adjacently positioned reels 90 and 92, it should be understood that a greater or fewer number of reels could be used, depending on the sizes thereof.

Figure 5:
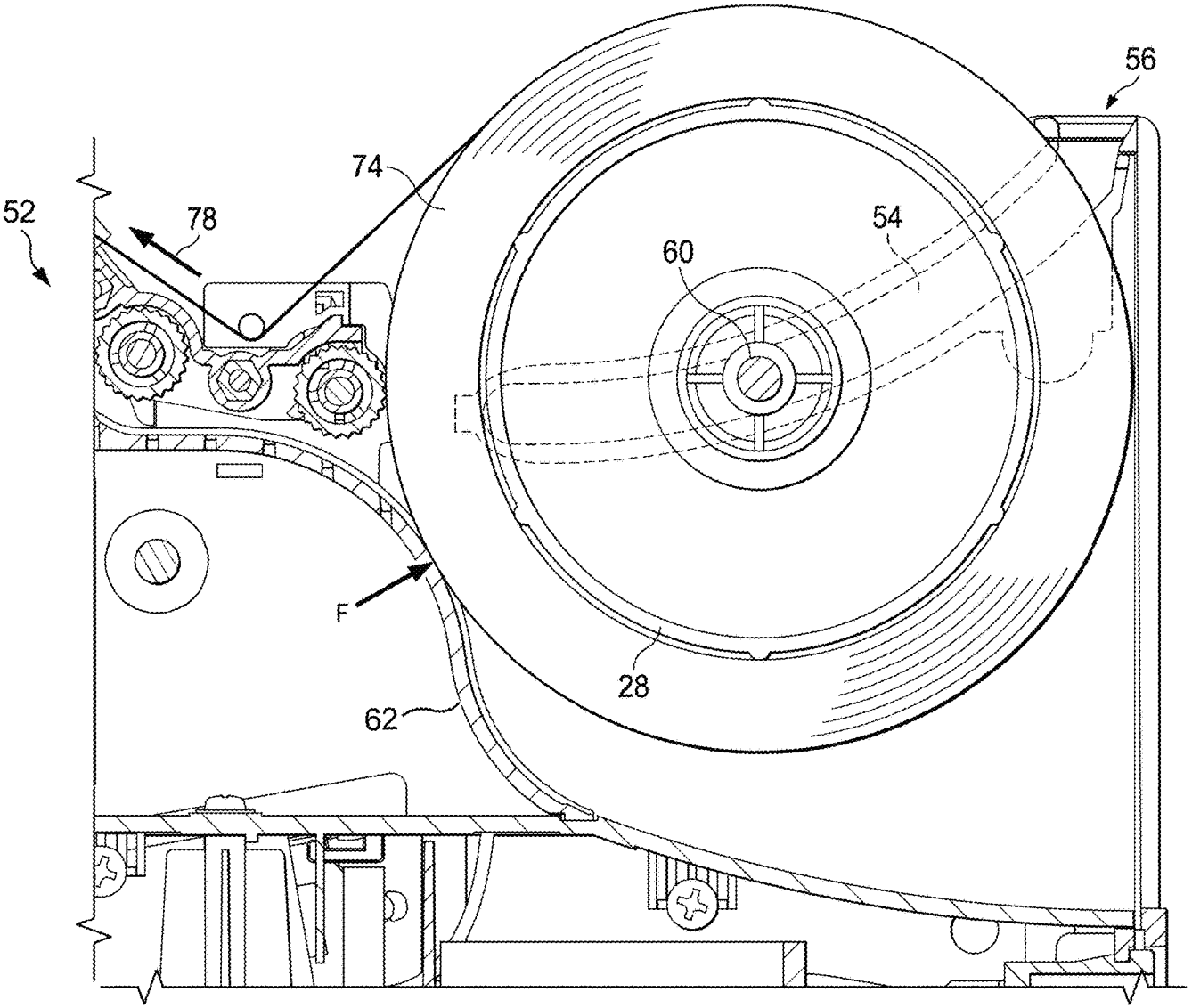
FIG. 5 a side view of a portion of the cover illustrating the reel assembly on the track.

Referring now to FIG. 5, the tensioning of the tape as it is peeled from the tape roll 74 is explained in greater detail. In operation, as the diameter of the tape roll 74 decreases (as a result of tape being peeled away from the tape roll 74), the shaft 60 and thus the tape-roll 74 move downward along the track 54 and thus closer to the feed system 52. In particular, as the diameter of the tape roll 74 decreases, the shaft 60 slides downward along the arcuately formed track 54. At all times, the tape roll 74 rests on the tape support deck 62, as seen, for example, in FIG. 5. As illustrated, the tape support deck 62 provides and/or otherwise exerts a normal force F in a direction perpendicular to the point where the tape roll 74 contacts the tape support deck 62 (i.e., the tangent point). Accordingly, as the tape is peeled from the tape roll 74 in the direction of arrow 78, the tape support deck 62 exerts normal force F on the tape roll 74 in order to maintain proper tension on the tape as it is pulled in the direction of arrow 78.

According to embodiments disclosed herein, the shape of the tape support deck 62 coupled with the shape of the track 54 enables the location of the normal position and direction force F to vary in direct response to the diameter of the tape roll 74, and thus, the position of the reel 28. For example, as the diameter of the tape decreases, the point of contact of the on the tape support deck 62 varies and the position of the shaft 60 within the track varies to maintain the appropriate and desired tension on the tape as it is pulled and/or otherwise peeled away from the tape roll 74.

Figure 6:
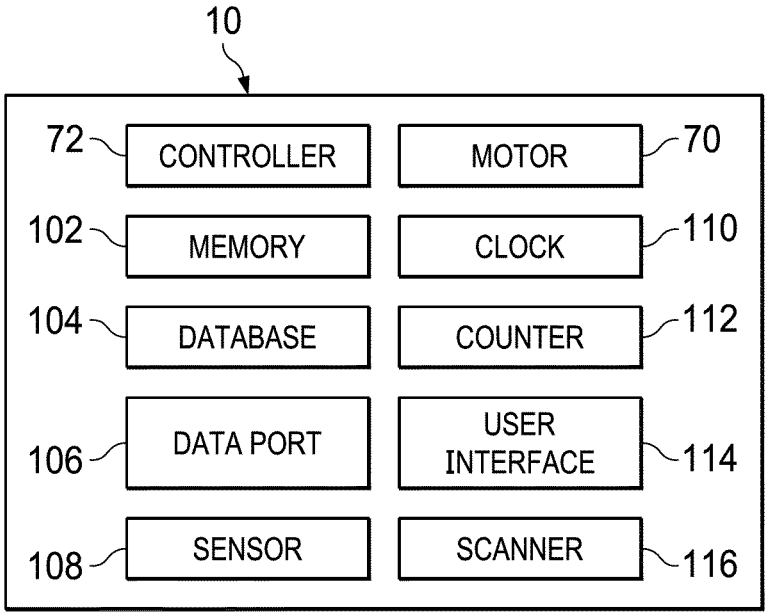
FIG. 6 is a block diagram of the tape dispenser system of FIGS. 1-5.

With reference to FIG. 6, a block diagram of the tape dispensing system 10 is illustrated in which a controller 72 is employed to advantage to operate the system 10. In the embodiment illustrated in FIG. 6, the dispensing system 10 includes, a memory 102 having a database 104, a data port 106 to enable remote programming of the system 10, a sensor 108, a clock 110, a counter 112, a user interface 114 and a scanner 116, such as, for example, a barcode scanner. In operation, the controller 72 controls the operation of the motor 70 such as, for example, varying the speed of the motor 70 depending on the type of tape, including the width and/or thickness thereof. For example, thinner and/or narrower tapes dispense more effectively at lower speeds while thicker, heavier and/or wider tapes dispense more effectively at faster speeds. Accordingly, the parameters of desired operational characteristics can be stored in the database 104 such that, when thinner or narrower tapes are used, a pre-stored operational mode can be selected by the user to accommodate the particular type of tape being dispenses. In other embodiments, the sensor 108 detects a characteristic of tape being dispensed and automatically adjusts the speed of the motor 70 based on the characteristic of the tape being dispensed. In yet other embodiments, the characteristic of the tape being dispensed can be determined by scanning a barcode associated with the specific tape type via the scanner 116. In operation, the controller 72 determines the identity of the type of tape via the barcode and retrieves from memory 102 the stored characteristics of the tape for effective dispensing (adjusting a dispensing speed based on the tape type). In other embodiments, the barcode scanner 116 or other type of system identifier can be used to for establishing a length of tape for a cycle. For example, the controller 72 is operable to receive a signal from the barcode scanner in response to scanning a barcode. The controller 72 accesses the memory 102 for the value corresponding to the barcode to automatically select the predetermined dispensing length.

With continued reference to FIG. 6, the clock 110 is operable to store a "birthday" of the system 10. According to some embodiments, a "birthday" is the number of feeds and cuts of the system. For example, a feed and corresponding cut is one cycle. According to some embodiments, the number of cycles is used to determine the age and/or extent of use of the system 10 for purposes warranties and maintenance.

The counter 112 is operable to count either up to or down from a predetermined number of cycles. For example, the system 10 may be programmed to alert the user that maintenance is necessary after 50 k cycles. As such, the counter 112 would track the cycles and once the predetermined number of cycles has occurred, the controller 72 can send a signal to display an alert to the user, either via the user interface 114 and additionally and/or alternatively, via an audible alert or other indicators (i.e., a blinking light, system shut down, etc.). In addition, the counter 112 is operable to keep track of production.

In the embodiment illustrated in FIG. 6, the user interface 114 may be any device operable to receive inputs from a user and communicate outputs to the user. For example, in some embodiments, the user interface 114 includes a display screen (i.e., an LCD) to allow a user to select the speed (increases or decreases thereof) and a length of tape to be dispensed. The user interface 114 is also operable to display the number of cycles, errors and/or error codes. According to some embodiments, the user interface 114 may include a speaker or blinking light (not illustrated) to provide a means to communicate to a user. According to other embodiments, the user interface 114 may include a user lock-out function via a passcode to prevent users from adjusting preset functions, although the user lock-out can be otherwise configured, such as, for example, a mechanical switch operable via a key.

In certain embodiments, the dispensing system 10 is operable to be placed between an operational mode, for normal dispensing of tape, and a maintenance or diagnostic mode, for testing and diagnostics. In the maintenance mode, the controller 72 performs self-diagnostic routines to detect the condition and operation of components such as, for example, a feed motor, a cutter motor, an auto feed sensor, the user interface 114, and certain functionality of the circuit board.

According to certain embodiments, the tape dispensing system can be battery operated or supplied with ac power via a power cord 100, as best illustrated in FIG. 1. According to some embodiments, the tape dispensing system 10 is configured to be hung from a rack or other support structure (e.g., a wall or otherwise) so as to be stored above a working surface. According to some embodiments, the bottom wall 24 includes one or more slots configured to receive a hanging pin or other structure extending from a wall or other support surface to secure the dispensing system thereto.

Embodiments disclosed herein also provide a method of using a tape dispenser system 10, the tape dispenser 10 including a feed system 52, a track 54, and a reel 28 for supporting the tape thereon. In operation, the reel 28 is movable from the first end 56 of the track 54 to the second end 58 of the track in response to tape being dispensed from the dispenser system 10. The method includes, in part, the steps of providing a scanner or other detection device 116 on the tape dispenser 10, the scanner 116 operable to read a predetermined pattern indicative (e.g., a barcode, QR code, etc.) of or corresponding to one or more operational parameters (e.g., speed, length of tape to be dispenses, etc.) of the tape dispenser 10. The method further includes reading, by the scanner 116, the predetermined pattern and in response to reading the predetermined pattern, adjusting the one or more operational parameters such that upon dispensing tape from the tape dispenser 10, the tape dispenser 10 operates according to the one or more operational parameter.

In the foregoing description of certain embodiments, specific terminology has been resorted to for the sake of clarity. However, the disclosure is not intended to be limited to the specific terms so selected, and it is to be understood that each specific term includes other technical equivalents, which operate in a similar manner to accomplish a similar technical purpose.

In the specification and claims, the word "comprising" is to be understood in its "open" sense, that is, in the sense of "including", and thus not limited to its "closed" sense, that is the sense of "consisting only of". A corresponding meaning is to be attributed to the corresponding words "comprise", "comprised" and "comprises" where they appear.

In addition, the foregoing describes only some embodiments of the invention(s), and alterations, modifications, additions and/or changes can be made thereto without departing from the scope and spirit of the disclosed embodiments, the embodiments being illustrative and not restrictive.

Furthermore, invention(s) have described in connection with what are presently considered to be the most practical and preferred embodiments, it is to be understood that the invention is not to be limited to the disclosed embodiments, but on the contrary, is intended to cover various modifications and equivalent arrangements included within the spirit and scope of the invention(s), as defined solely by the appended claims. Also, the various embodiments described above may be implemented in conjunction with other embodiments, e.g., aspects of one embodiment may be combined with aspects of another embodiment to realize yet other embodiments. Further, each independent feature or component of any given assembly may constitute an additional embodiment.

What is claimed is:

1. An automatic tape dispenser comprising:

a controller;

a reel for supporting a tape roll thereon;

a track, the reel movable along the track between a first end of the track and a second end of the track in response to tape being dispensed from the dispenser; and a sensor communicatively coupled to the controller, wherein the sensor is operable to detect a characteristic of the tape such that in response to detecting the characteristic, a speed of a feed system is adjusted.

2. The automatic tape dispenser of claim 1, further comprising:

at least a portion of the track having an arcuate path, and wherein a deck exerts a normal force in a direction perpendicular to a point where the tape roll contacts the deck.

3. The dispenser of claim 1, wherein the first end of the track is higher than the second end of the track.

4. The dispenser of claim 1, wherein the reel is mounted on a shaft, the shaft having ends disposed within the track.

5. The dispenser of claim 1, wherein the second end of the track is between the feed system and the first end of the track.

6. The dispenser of claim 1, wherein the characteristic is a tape thickness.

7. The dispenser of claim 1, wherein the characteristic is a tape width.

8. The dispenser of claim 7, further comprising a memory, the memory configured to store a plurality of operating modes.

9. The dispenser of claim 8, wherein the operating modes are user selected.

10. The dispenser of claim 1, wherein the controller configured to record a number of cycles of the dispenser, wherein at least one of the cycles corresponds to a number of feeds and cuts performed by the dispenser.

11. The dispenser of claim 1, wherein the sensor is a barcode scanner such that in response to reading a barcode, the controller determines the characteristic of the tape by retrieving from a memory the characteristic of the tape.

12. An automatic tape dispensing system comprising:

a feed system having a plurality of rollers, the feed system configured for peeling a tape from a tape roll and dispensing the tape from the dispensing system;

a reel for supporting the tape thereon, the reel having an axis;

a deck for supporting the tape roll thereon;

a track supporting the reel, the reel movable along the track such that in response to tape being dispensed from the dispensing system, the axis moves in a direction closer to the deck; and wherein the deck exerts a normal force in a direction perpendicular to a point where the tape roll contacts the deck in order to maintain a desired tension on the tape roll.

13. The system of claim 12, wherein the track arcuately extends from a first end to a second end.

14. The system of claim 12, wherein the reel is mounted on a shaft, the shaft having ends disposed within the track.

15. The system of claim 12, wherein the track comprises a first end and a second end, and wherein the second end of the track is between the feed system and the first end.

16. The system of claim 12, further comprising a microcontroller, the microcontroller configured to vary a speed of a motor.

17. The system of claim 12, further comprising a removable cover enclosing the feed system.

18. The system of claim 17, wherein the track is formed on a top surface of the removable cover.

19. The system of claim 12, wherein the controller is configured to receive a user input for a selected length of tape output.

20. An automatic tape dispenser comprising:

a controller;

a reel for supporting a tape roll thereon;

a feed system, the feed system comprising a push roller and a plurality of feed rollers to peel and receive tape from a tape roll;

a sensor communicatively coupled to the controller, wherein the sensor is operable to detect a characteristic of the tape such that in response to detecting the characteristic, an operation of the feed system is adjusted; and a track, at least a portion of the track having an arcuate path, the reel movable along the arcuate path between a first end of the track and a second end of the track in response to the tape being dispensed from the dispenser; and wherein a deck exerts a normal force in a direction perpendicular to a point where the tape roll contacts the deck.

21. The automatic tape dispenser of claim 20, wherein the operation of the feed system is the velocity of the feed system.

22. The automatic tape dispenser of claim 20, wherein the sensor is a barcode scanner.

* * * * *